US009352455B2

(12) United States Patent
Steele et al.

(10) Patent No.: US 9,352,455 B2
(45) Date of Patent: May 31, 2016

(54) FASTENER DRIVER AND EXTENSION

(71) Applicant: Milwaukee Electric Tool Corporation, Brookfield, WI (US)

(72) Inventors: Michael S. Steele, Waukesha, WI (US); Steven G. Melnyk, Grafton, WI (US); Thomas G. Simeone, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 767 days.

(21) Appl. No.: 13/623,402

(22) Filed: Sep. 20, 2012

(65) Prior Publication Data

US 2013/0068073 A1 Mar. 21, 2013

Related U.S. Application Data

(60) Provisional application No. 61/536,711, filed on Sep. 20, 2011.

(51) Int. Cl.
*B25B 13/06* (2006.01)
*B25B 23/00* (2006.01)
*B25G 1/04* (2006.01)

(52) U.S. Cl.
CPC ..... *B25B 13/06* (2013.01); *B25B 23/0035* (2013.01); *B25G 1/043* (2013.01)

(58) Field of Classification Search
CPC ..... B25B 23/0021; B25B 23/0035; B25B 13/481; B25B 13/06; B25G 1/043; B25G 1/005
USPC ..... 81/177.2, 177.85, 436, 459, 124.4
See application file for complete search history.

(56) References Cited

U.S. PATENT DOCUMENTS

| | | | | |
|---|---|---|---|---|
| 2,438,633 | A | | 3/1948 | Condor |
| 2,676,506 | A | | 4/1954 | Shultz |
| 2,718,806 | A | | 9/1955 | Clark |
| 2,963,930 | A | | 12/1960 | Clothier et al. |
| 3,086,414 | A | | 4/1963 | Nardi |
| 3,339,439 | A | | 9/1967 | Dalen et al. |
| 3,715,168 | A | | 2/1973 | Kuhn |
| 3,837,244 | A | | 9/1974 | Schera, Jr. |
| 4,307,634 | A | | 12/1981 | Gentry |
| 4,393,583 | A | | 7/1983 | Zwald |
| 4,413,660 | A | | 11/1983 | Conrad |
| 4,620,460 | A | * | 11/1986 | Gonzales, Jr. ..... 81/124.4 |
| 4,689,881 | A | | 9/1987 | Fall |
| 4,724,731 | A | | 2/1988 | Onofrio |

(Continued)

*Primary Examiner* — Robert Scruggs
(74) *Attorney, Agent, or Firm* — Michael Best & Friedrich LLP

(57) ABSTRACT

A fastener driver configured for use with a rotary power tool having a chuck. The fastener driver includes a drive including a shank, an elongated extension including an aperture that extends through the elongated extension, and the drive is removably coupled to the elongated extension. The fastener driver further includes a driver including an aperture that extends through the driver and a drive to engage a fastener to rotate the fastener, and the driver is removably coupled to elongated extension to allow the fastener to pass through the aperture of the driver and into the aperture of the elongated extension. The fastener driver further includes a connector that couples the driver to the drive for co-rotation without the elongated extension when the elongated extension is not utilized and the connector couples the driver, the elongated extension, and the drive for co-rotation when the elongated extension is utilized.

16 Claims, 8 Drawing Sheets

(56) References Cited

U.S. PATENT DOCUMENTS

| | | | | |
|---|---|---|---|---|
| 4,905,548 | A | 3/1990 | Colace et al. | |
| 5,012,624 | A | 5/1991 | Dahlgren | |
| 5,168,781 | A | 12/1992 | Tenuta | |
| 5,255,485 | A | 10/1993 | Lemke et al. | |
| 5,615,587 | A | 4/1997 | Foerster, Jr. | |
| 5,782,148 | A | 7/1998 | Kerkhoven | |
| 5,809,851 | A | 9/1998 | Thompson | |
| 5,943,922 | A | 8/1999 | Rolfe | |
| 5,950,507 | A * | 9/1999 | Wolfe | 81/177.2 |
| 6,035,747 | A | 3/2000 | Valela | |
| 6,050,157 | A | 4/2000 | Ludwig | |
| 6,170,365 | B1 | 1/2001 | Zerver | |
| 6,257,099 | B1 | 7/2001 | Rosenbaum | |
| 6,324,946 | B1 | 12/2001 | Gasser et al. | |
| 6,354,176 | B1 | 3/2002 | Nordlin | |
| 6,658,969 | B2 | 12/2003 | Jones | |
| 6,715,384 | B1 | 4/2004 | Kozak | |
| 6,732,615 | B2 | 5/2004 | Layaou | |
| 6,786,116 | B2 | 9/2004 | Dockery | |
| 6,931,966 | B2 | 8/2005 | Monroig et al. | |
| 7,036,401 | B2 | 5/2006 | Carroll | |
| 7,082,864 | B1 | 8/2006 | Weber | |
| 7,104,165 | B2 | 9/2006 | Chu | |
| 7,185,568 | B1 | 3/2007 | Vance | |
| 7,231,852 | B1 | 6/2007 | Henin et al. | |
| 7,237,291 | B2 | 7/2007 | Redford | |
| 7,249,540 | B1 | 7/2007 | Hacker et al. | |
| 7,306,396 | B1 | 12/2007 | Chen | |
| 7,363,839 | B2 | 4/2008 | Chiang | |
| 7,430,943 | B2 | 10/2008 | Chiang | |
| 7,481,136 | B2 | 1/2009 | Chiang | |
| 7,651,303 | B2 | 1/2010 | Zick et al. | |
| 7,841,261 | B2 | 11/2010 | Milligan et al. | |
| 7,942,426 | B2 | 5/2011 | Peters | |
| 2004/0074344 | A1 * | 4/2004 | Carroll | 81/121.1 |
| 2006/0037184 | A1 | 2/2006 | Miller | |
| 2006/0191383 | A1 | 8/2006 | Woods et al. | |
| 2006/0196321 | A1 | 9/2006 | Carroll | |
| 2006/0266166 | A1 | 11/2006 | Weber | |
| 2008/0196562 | A1 | 8/2008 | Elliston et al. | |
| 2011/0048175 | A1 | 3/2011 | LeVert | |
| 2011/0097169 | A1 | 4/2011 | Kazda et al. | |

* cited by examiner

FASTENER DRIVER AND EXTENSION

CROSS-REFERENCE TO RELATED APPLICATIONS

This application claims priority to U.S. Provisional Application 61/536,711, filed Sep. 20, 2011, the entire contents of which are hereby incorporated by reference herein.

BACKGROUND

The present invention relates to a fastener driver and extension.

Fastener drivers can be used to rotate fasteners, including nuts, bolts, screws, and the like. Fastener drivers, such as sockets, typically include a socket or driver and a handle that rotates the socket. In some applications, an extension is placed between the socket and the handle so that the user can access fasteners that are difficult to reach or where it is not possible or comfortable position the handle of the fastener driver close to the fastener. In other applications, deep sockets are used, often in applications where a nut is threaded onto a relatively long threaded rod and the rod must pass through the nut.

SUMMARY

In one embodiment, the invention provides a fastener driver configured for use with a rotary power tool having a chuck. The fastener driver includes a drive including a shank configured to be received in the chuck of the rotary power tool to couple the fastener driver to the rotary power tool for rotation with the chuck, an elongated extension including a first end, a second end, an aperture that extends through the first end and the second end, and the drive removably coupled to the elongated extension adjacent the first end of the extension, and a driver including a first end, a second end, an aperture that extends through the first end and the second end, a drive member adjacent the first end and configured to engage a fastener to rotate the fastener, and the driver is removably coupled to elongated extension adjacent the second end of the elongated extension to allow the fastener to pass through the aperture of the driver and into the aperture of the elongated extension. The fastener driver further includes a connector that couples the driver to the drive for co-rotation without the elongated extension when the elongated extension is not utilized and the connector couples the driver, the elongated extension, and the drive for co-rotation when the elongated extension is utilized.

In another embodiment the invention provides a fastener driver configured for use with a rotary power tool having a chuck, the fastener driver includes a drive including a shank configured to be received in the chuck of the rotary power tool to couple the fastener driver to the rotary power tool for rotation with the chuck, an elongated extension including a first end, a second end, a cylindrical outer surface that extends from the first end to the second end, an aperture that extends through the first end and the second end, and the drive removably coupled to the elongated extension adjacent the first end of the extension. The fastener driver further includes a driver including a first end, a second end, an aperture that extends through the first end and the second end, a drive member adjacent the first end configured to engage a fastener to rotate the fastener, and the driver removable coupled to elongated extension adjacent the second end of the elongated extension to allow the fastener to pass through the aperture of the driver and into the aperture of the elongated extension.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
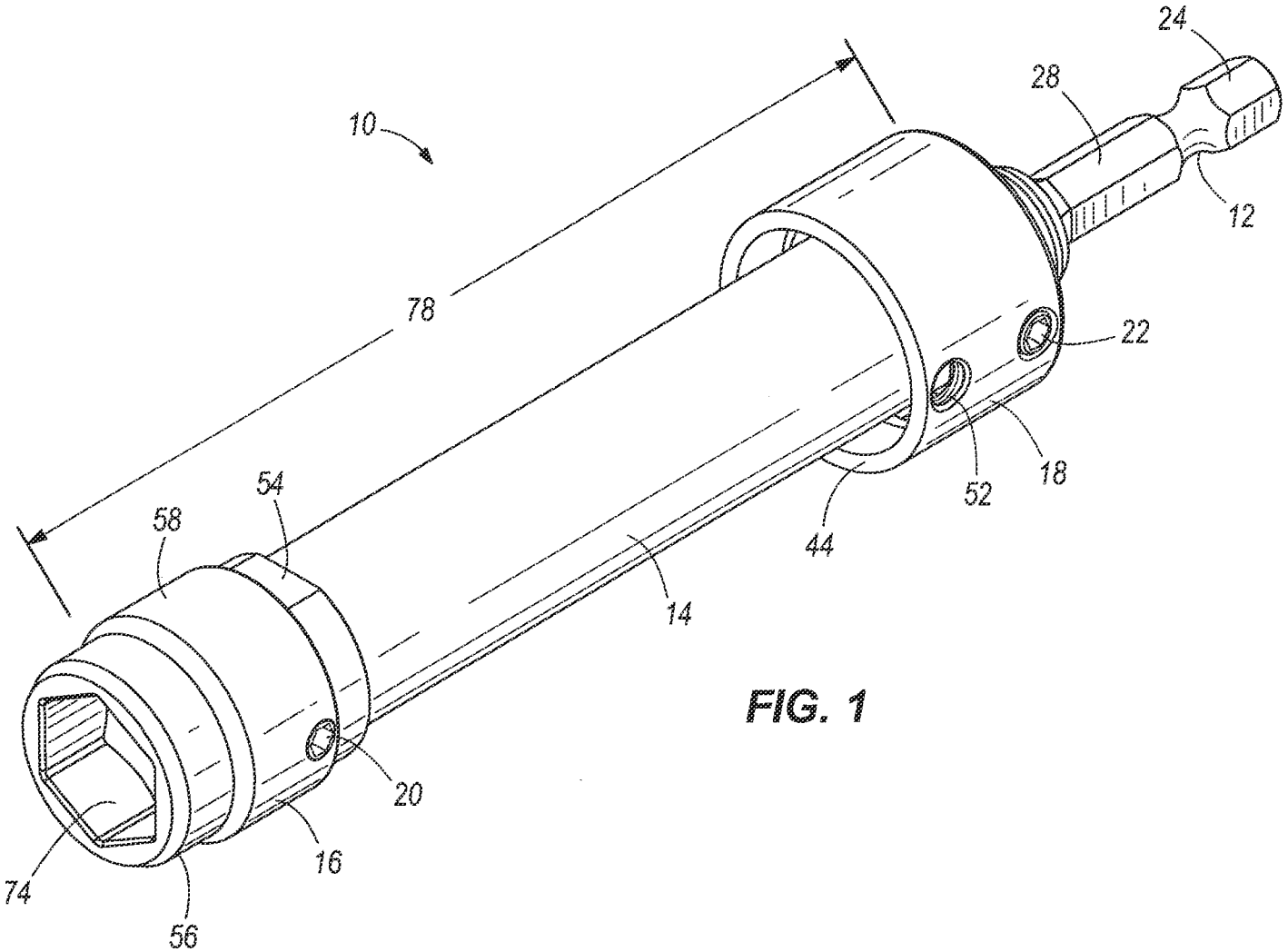
FIG. 1 is a perspective view of a fastener driver and extension according to one embodiment of the invention.

FIG. 1 illustrates a fastener driver and extension 10. The illustrated fastener driver and extension 10 includes a drive 12, an extension 14, a driver 16, a connector 18, and fasteners 20 and 22 that are used to fasten the fastener driver and extension 10 together as will be discussed in more detail below.

Figure 2:
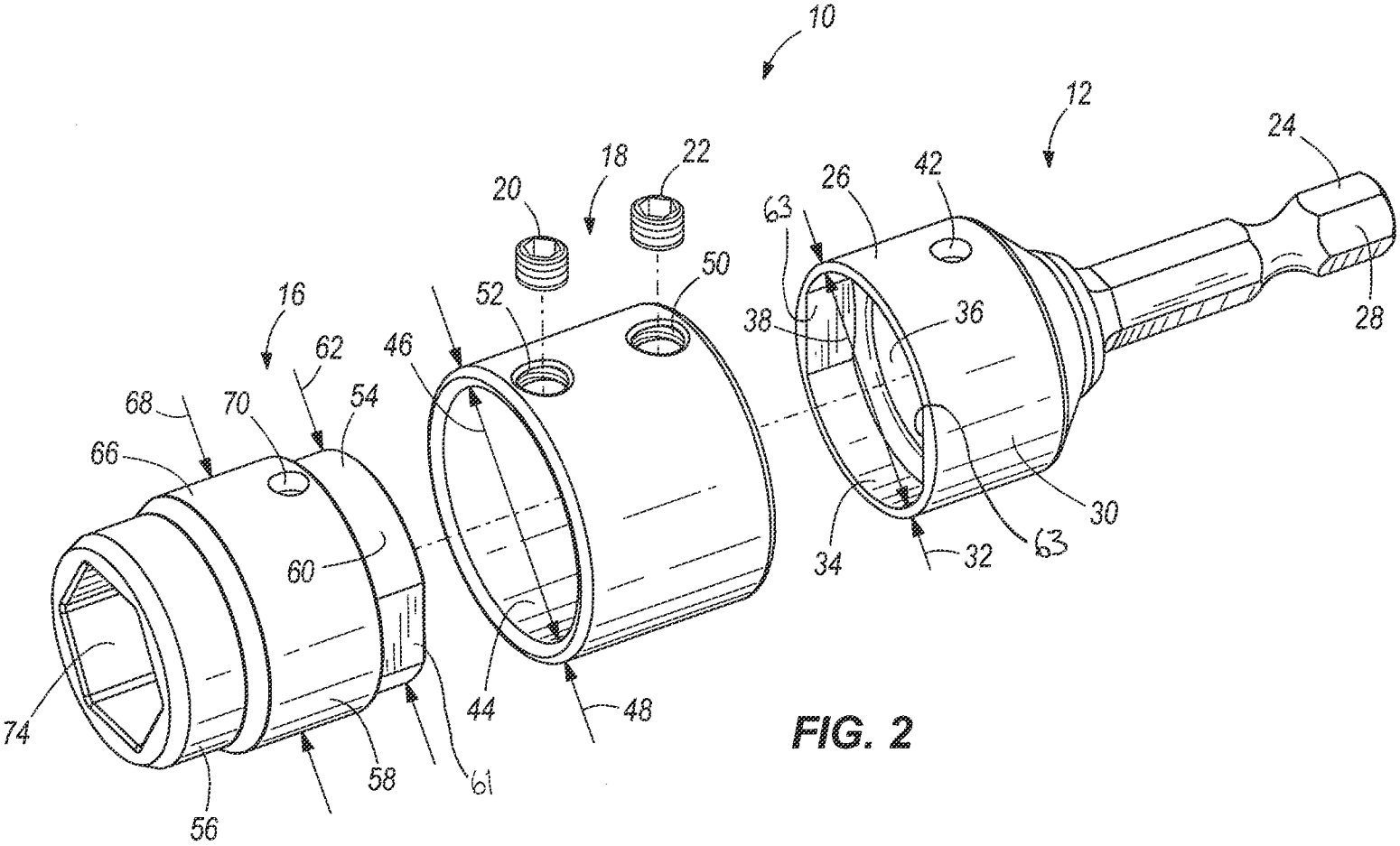
FIG. 2 is an exploded view of the fastener driver and extension of FIG. 1 with an extension removed.

Referring to FIG. 2, the drive 12 includes a first end portion 24 and a second end portion 26. The first end portion 24 includes a shank 28. The illustrated shank 28 includes a hex shaped outer surface and is configured to be received in a chuck of a rotary power tool such as a drill, driver, and the like. In other embodiments, the shank can be shaped to be received in other tools, such as a hand tool, including a socket wrench and the like. In such embodiments, the shank may have a square shaped outer surface.

The second end portion 26 of the drive 12 includes an outer surface 30. In the illustrated embodiment, the outer surface 30 is cylindrical and has a diameter 32. However, in other embodiments, the outer surface of the second end portion of the drive can have other suitable shapes, such as hexagonal, square, etc. The second end portion 26 further includes a first aperture 34 and a second aperture 36 that is concentric with the first aperture 34. Although the illustrated first aperture 34 is generally cylindrical and has a diameter 38, in other embodiments, the first aperture can have other suitable shapes, such as square, hexagonal, etc. The second aperture 36, which is a blind bore, is also cylindrical or circular and has a diameter that is less than the diameter 38 of the first aperture 34. Although the illustrated second aperture 36 is cylindrical, in other embodiments, the second aperture can have other suitable shapes, such as square, hexagonal, etc. A fastener aperture 42 extends from the second aperture 36 through the outer surface 30 of the drive 12. The fastener aperture 42, which is not threaded in the illustrated embodiment, receives the fastener 22 to couple the drive 12 and the connector 18. In other embodiments, the fastener aperture 42 is threaded and the fastener 22 is also threaded (e.g., a screw) and the drive 12 and the connector 18 are removably coupled via the fastener 22. In other embodiments, the fastener apertures and fastener may not be threaded and the fastener can be other suitable types of fasteners, such as a pin, a magnet, and the like.

With continued reference to FIG. 2, the illustrated connector 18 is generally in the form of a hollow cylinder and includes a central aperture 44 having a diameter 46 and the connector 18 includes an outer diameter 48. The diameter 46 of the aperture 44 is sized slightly larger than the outer diameter 32 of the drive 12 such that the second end 26 of the drive 12 can be received in the aperture 44 of the connector 18. Although the illustrated connector 18 includes the circular central aperture 44, in other embodiments, the aperture 44 can have other shapes that match the shape of the outer surface 30 of the drive 12 (e.g., both hexagonal shape).

Figure 4:
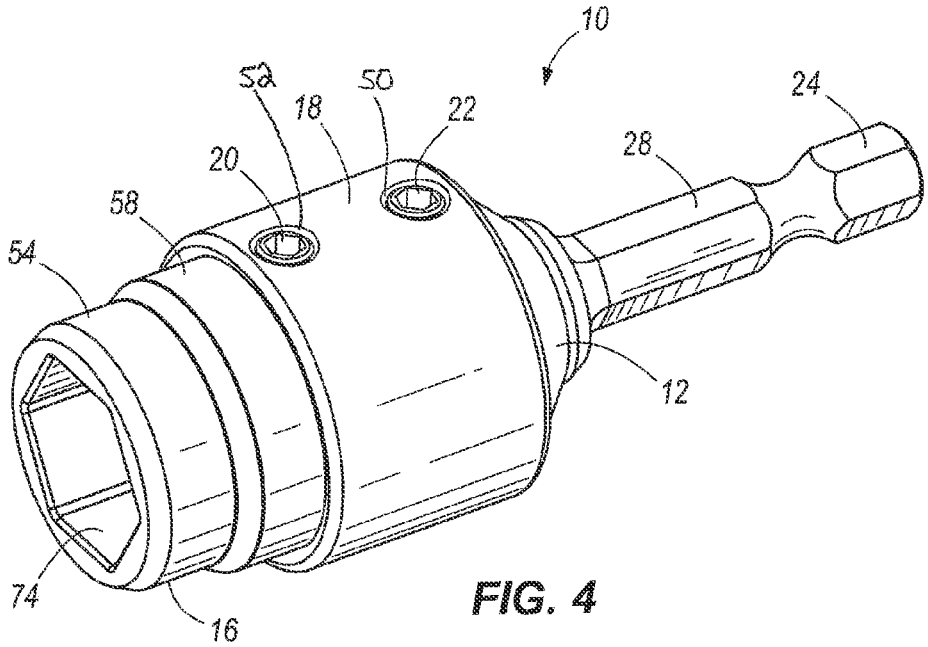
FIG. 4 is an assembled view of the fastener driver and extension of FIG. 1 with the extension removed.
Figure 5:
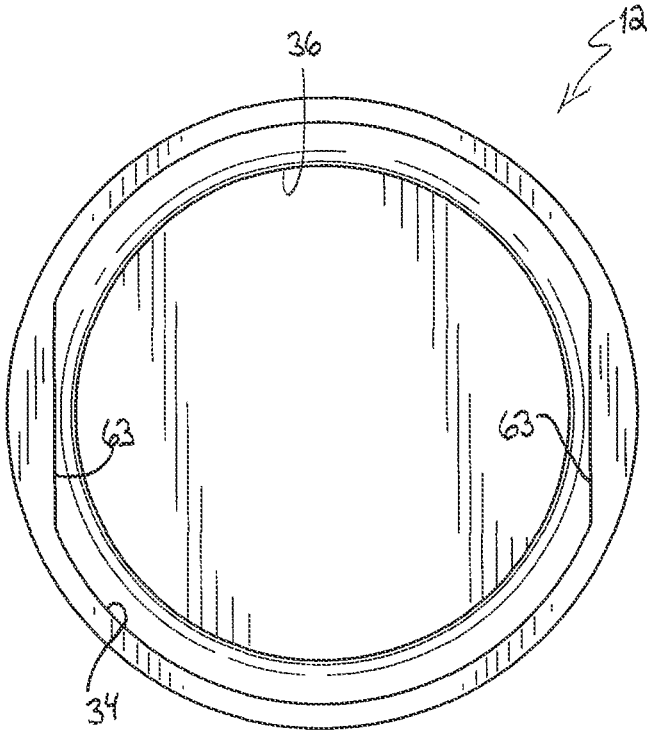
FIG. 5 is an end view of a drive of the fastener driver of FIG. 1.

The connector 18 further includes a first aperture 50 and a second aperture 52. As illustrated in FIG. 4, the first aperture 50 receives the fastener 22 to couple the connector 18 and the drive 12 and the second aperture 52 receives the fastener 20 to couple the connector 18 and the driver 16. In the illustrated embodiment, the apertures 50, 52 are threaded.

Figure 6:
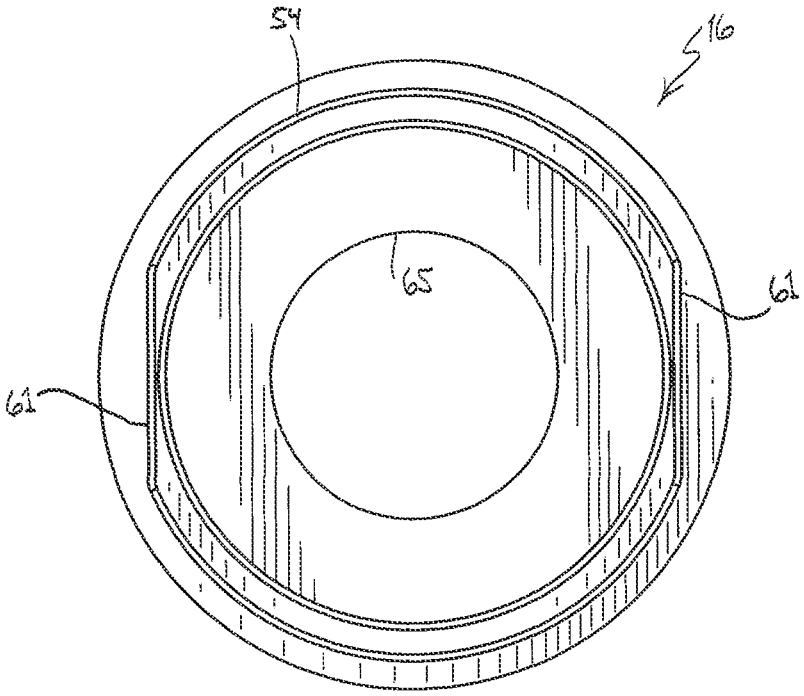
FIG. 6 is an end view of a driver of the fastener driver of FIG. 1.
Figure 7:
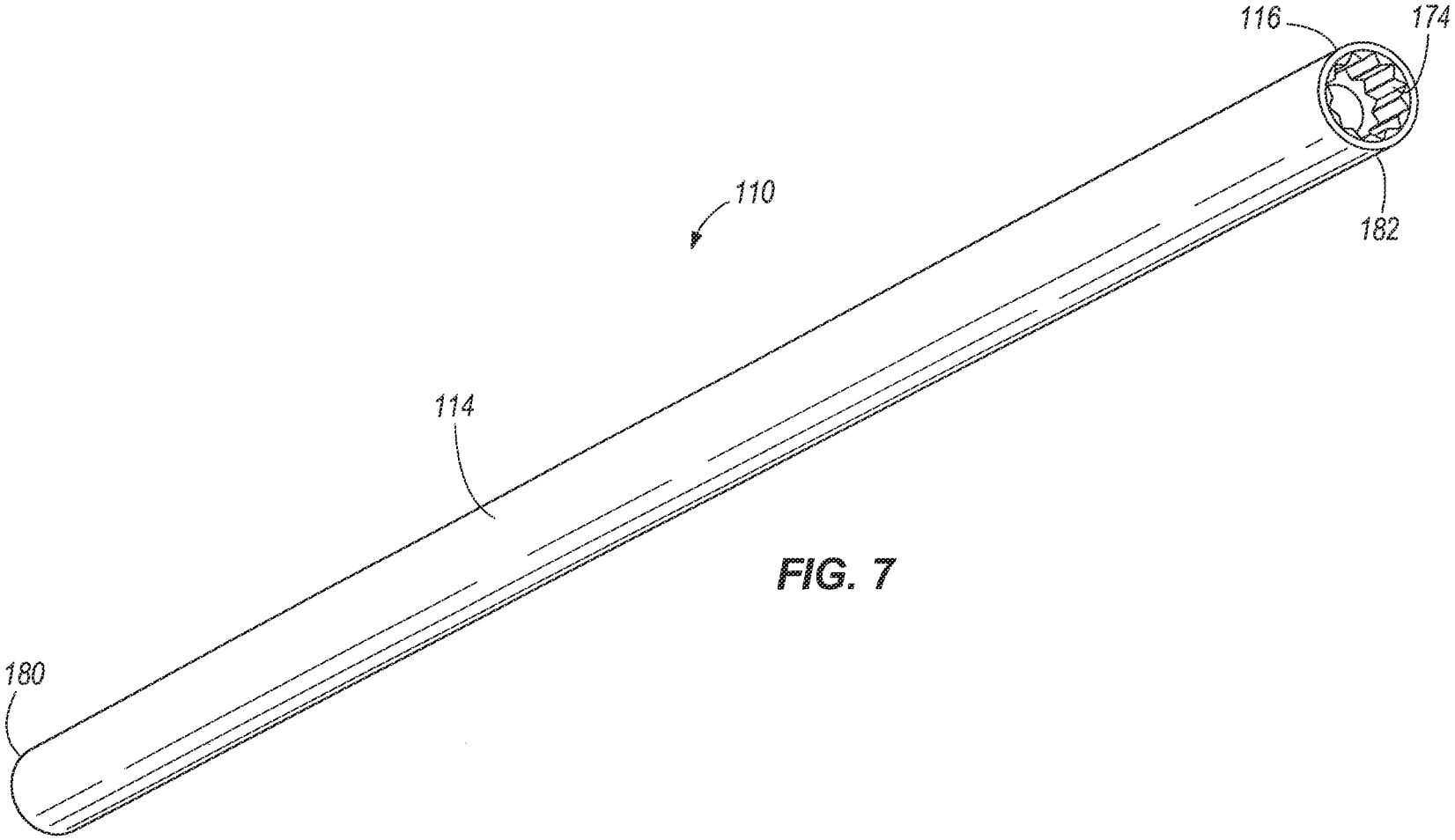
FIG. 7 is a perspective view of a fastener driver and extension according to another embodiment of the invention.

Referring to FIG. 2, the driver 16 includes a first end portion 54, a second end portion 56 and an intermediate portion 58 between the first end portion 54 and the second end portion 56. The first end portion 54 includes an outer surface 60, which is substantially cylindrical, but includes flat surfaces 61, and the surface 60 has a diameter 62 in the illustrated embodiment. The diameter 62 is sized slightly smaller than the diameter 38 of the aperture 34 of the drive 12 so that the first end portion 54 of the driver 12 can be received within and removed from the aperture 34 of the drive 12. The flat surfaces 61 of the driver 16 engage the flat surfaces 63 of the drive 12 to facilitate co-rotation of the drive 12 and the driver 16. Although the illustrated outer surface 60 of the driver 16 is cylindrical to match the cylindrical aperture 34 of the drive 12, in other embodiments, the outer surface of the driver and the aperture of the drive can have other suitable matching shapes (e.g., square, hexagonal, etc.). The driver 16 further includes an aperture 65 (FIG. 6) that extends longitudinally through the driver 16.

Figure 3:
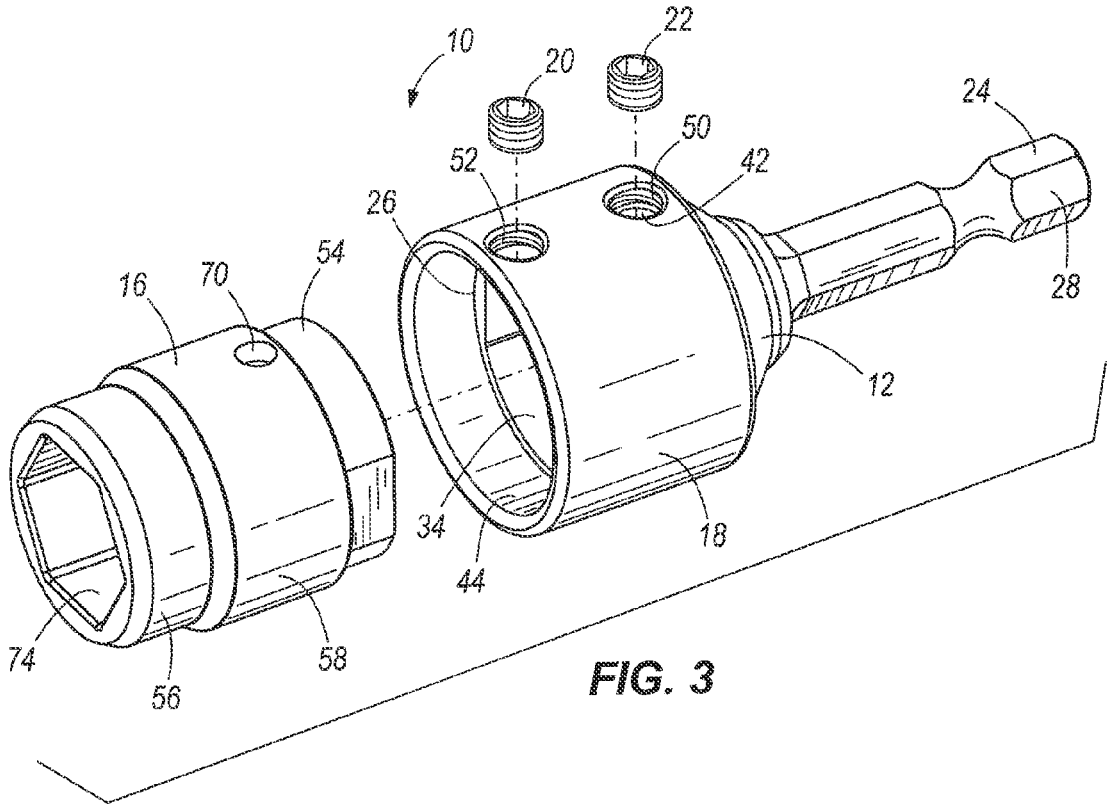
FIG. 3 is a partially exploded view of the fastener driver and extension of FIG. 2.

The intermediate portion 58 of the illustrated driver 16 is generally cylindrical and includes an outer surface 66 having a diameter 68. In the illustrated embodiment, the diameter 68 of the driver 16 is equal to the diameter 32 of the second end 26 of the drive 12. The diameter 68 of the driver 16 is sized slightly smaller than the diameter 46 of the connector 18 so that the driver 16 can be inserted into and removed from the aperture 44 of the connector 18 (FIGS. 3 and 4). Again, although the illustrated outer surface 66 of the intermediate portion 58 is generally cylindrical to match the circular central aperture 44 of the connector 18, in other embodiments the aperture 44 and the outer surface 66 can have other suitable matching shapes.

The intermediate portion 58 further includes a fastener aperture 70 that extends from the aperture 26 in the first end portion 54 of the driver 16 through the outer surface 66. The fastener aperture 70 receives the fastener 20 to removably couple the driver 16 to either the connector 18 (FIG. 4) or the extension 14 (FIG. 1), as will be discussed in more detail below. In other embodiments, the fastener aperture 70 is threaded and the fastener 20 is threaded (e.g., a screw), but in the illustrated embodiment, the fastener aperture 70 of the driver 16 is not threaded and the fastener 20 received therein is threaded. In other embodiments, other types of fasteners can be used, such as pins, magnets, etc.

Referring to FIG. 2, the second end portion 56 of the driver 16 includes a driving member 74, which in the illustrated embodiment is a ¼ inch hexagonal recess configured to receive a bolt head, nut, or the like. In other embodiments, the driving member 74 can have other suitable sizes (e.g., ⅛ inch, ½ inch, ¾ inch, etc.) and the driving member can be other suitable types of driving members, such as a square drive, screw driver head, and the like.

Referring to FIG. 1, the extension 14 is cylindrical in the illustrated embodiment and includes a first end received in the aperture 36 (FIG. 2) of the drive 12 and a second end received in the aperture formed in the first portion 54 of the driver 16. The extension 14 has a length 78 measured from the first end to the second end. In the illustrated embodiment, the extension 14 is formed from a piece of ½ inch diameter conduit and the conduit is cut to the desired length 78 by the user.

In operation, the user can utilize the fastener driver and extension 10 without the extension 14, as illustrated in FIG. 4, for applications where the user can easily position the rotary power tool or hand tool that receives the shank 28 close to the fastener (e.g., a nut and bolt combination) that is being driven by the fastener driver and extension 10. In this configuration of the fastener driver and extension 10, referring to FIGS. 2 and 4, the connector 18 is positioned by the user such that the aperture 50 of the connector 18 is aligned with the aperture 42 of the drive 12. Then, the user inserts the fastener 22 into the apertures 50 and 42 to couple the connector 18 and the drive 12 so that the connector 18 cannot move with respect to the drive 12. While the illustrated connector 18 and the drive 12 can be removeably coupled, in other embodiments, the connector and the drive can be formed as a single unitary component. The user also aligns the aperture 52 of the connector 18 with the aperture 70 of the driver 16 and inserts the fastener 20 through the apertures 52 and 70 to couple the driver 16 and the connector 18 such that the driver 16 cannot move with respect to the connector 18. Then, in the configuration illustrated in FIG. 4, the user inserts the shank 28 into a chuck of a rotary power tool or a hand tool and uses the tool to rotate the shank 28, which rotates the driving member 74 and the driving member 74 is used to rotate a fastener.

In some applications of the fastener driver and extension 10, access to the fastener to be driven is limited and the rotary power tool or hand tool cannot be positioned close to the fastener. In such applications, the user uses the extension 14 (FIG. 1) to position the tool further from the driver 16. In other applications, the fastener driver and extension 10 can be used to position and advance the fastener, such as a nut, a relatively large distance from an end of the bolt, threaded rod, or the like. In such applications, as the nut is being advanced along the bolt, portions of the bolt along which the nut had been advanced travel through the aperture 65 (FIG. 6) of the driver 16 into the hollow extension 14. Therefore, the fastener driver and extension 10 can be used to advance the nut about the length 78 along the bolt.

When the user desires to use the extension 14, the user can easily form the extension 14 from materials found around the jobsite. For example, the illustrated extension 14 is formed from a piece of ½ inch conduit. The user can use a scrap piece of conduit found at the jobsite and cut the conduit to the desired length 78. The conduit is then inserted into the aperture 36 (FIG. 2) of the drive 12 and into the aperture in the first end portion 54 of the driver 16. The extension 14 is then fastened to the drive 12 by inserting the fastener 22 into the aperture 50 of the connector 18 and through the aperture 42 of the drive 12. In one embodiment, the fastener 22 can extend into the extension 14 and in other embodiments the fastener 22 can extend all the way through a sidewall of the extension 14 if the extension 14 is hollow (e.g., conduit). In yet other embodiments, the extension is not hollow and the fastener 20 can extend through the solid extension. The fastener 22 then retains the extension 14 from movement with respect to the connector 18 and the drive 12. In the illustrated embodiment only one fastener 22 is used to couple the drive 12, the connector 18, and the extension 14, but in other embodiments more than one fastener can be used.

Also, the fastener 20 is inserted through the aperture 70 of the driver 16 to couple the driver 16 and the extension 14. In one embodiment, the fastener 20 extends into the extension 14 and in other embodiments, the fastener 20 extends all the way through the sidewall of the extension 14 if the extension 14 is hollow (e.g., conduit). In yet other embodiments, the extension is not hollow and the fastener 20 can extend through the solid extension. The fastener 20 then retains the extension 14 from movement with respect to the driver 16. In the illustrated embodiment, only one fastener 20 is used to couple the driver 16 and the extension 14, but in other embodiments more than one fastener can be used.

In the configuration illustrated in FIG. 1, the user can then use the fastener driver and extension 10 to drive a fastener similar to driving the fastener as discussed above with the fastener driven and extension 10 in the configuration of FIG. 4 without the extension 14. When the user is done using the extension 14, the user can remove the extension 14 and reassemble the fastener driver and extension 10 to the configuration of FIG. 4 as discussed above and the extension 14 can either be discarded or kept for future use.

FIGS. 7-10 illustrate a fastener driver and extension 110 according to another embodiment. The fastener driver and extension 110 includes features similar to the fastener driver and extension 10 of FIGS. 1-6 and like components have been give like reference numbers plus 100 and only differences between the fastener driver and extensions 10, 110 will be discussed in detail below.

Figure 10:
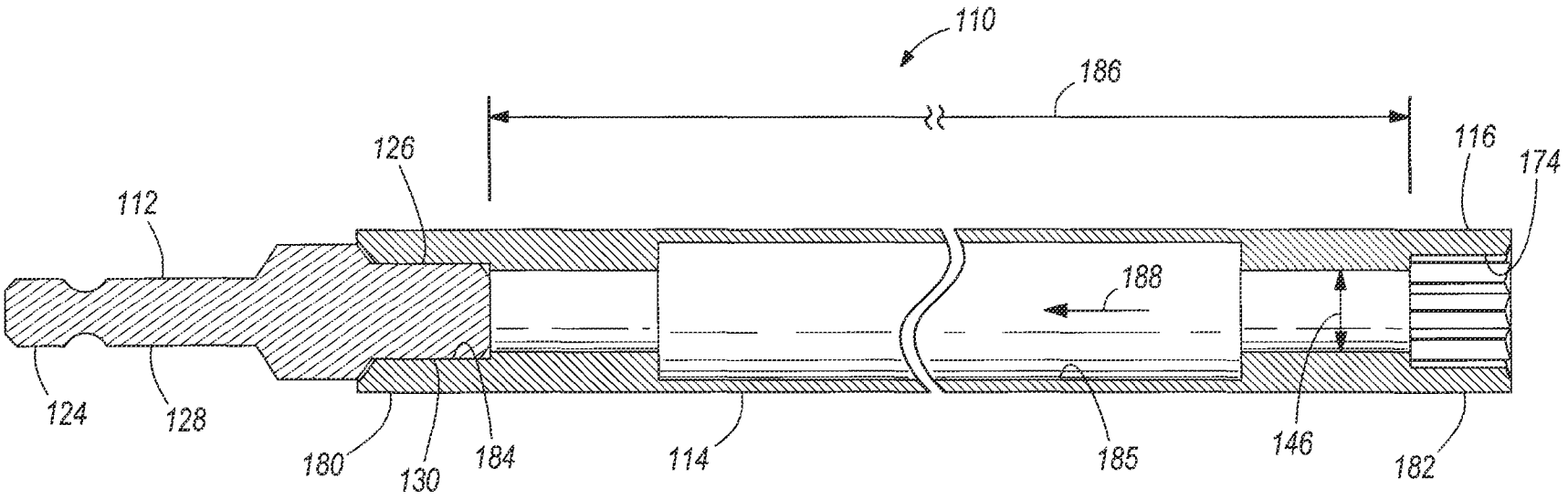
FIG. 10 is a cross-sectional view of the fastener driver and extension of FIG. 7 taken along lines 10-10 of FIG. 8.

Referring to FIG. 10, the fastener driver and extension 110 includes a drive 112, an extension 114, and a driver 116, and in the illustrated embodiment, the extension 114 and the driver 116 are integrally formed as a single unitary component.

With continued reference to FIG. 10, the drive 112 includes a first end portion 124 and a second end portion 126. The first end portion 124 includes a shank 128 having a hex shaped outer surface that is configured to be received in a chuck of a rotary power tool. The second end portion 126 includes an outer surface 130 that forms a square drive in the illustrated embodiment. In the illustrated embodiment, the drive 112 is a removably coupled to the extension 114. In other embodiments, the drive can be integrally formed with the extension as a single component.

Figure 8:
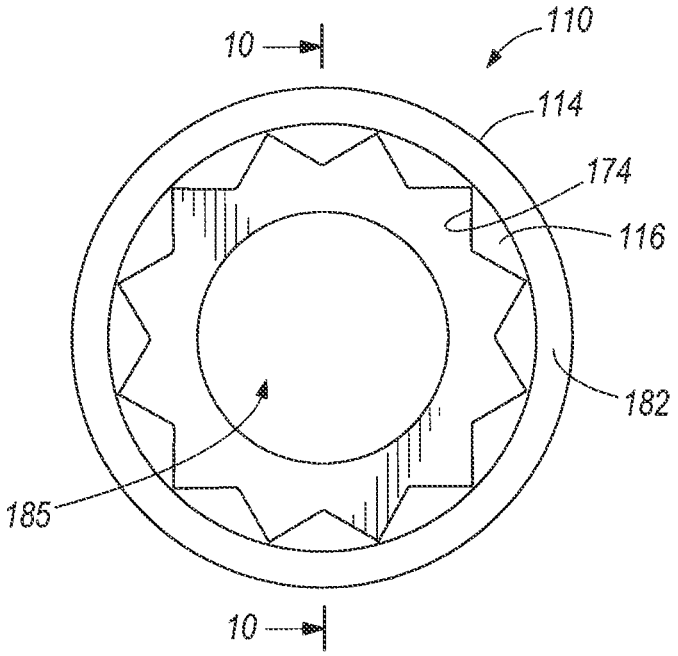
FIG. 8 is a first end view of the fastener driver and extension of FIG. 7.
Figure 9:
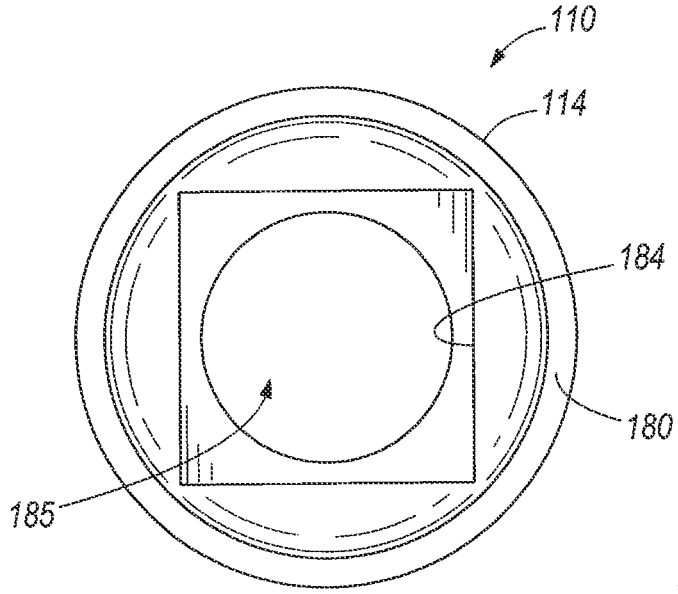
FIG. 9 is a second end view of the fastener and driver and extension of FIG. 7.

The extension 114 includes a first end portion 180 and a second end portion 182. Referring to FIGS. 9 and 10, the first end portion 180 includes an aperture 184. The illustrated aperture 184 is square and receives the second end portion 126 of the drive 112 (i.e., the square drive) such that rotation of the drive 112 rotates the extension 114 and the driver 116. Referring to FIGS. 8 and 10, the second end portion 182 of the extension 114 includes the driver 116 integrally formed with the extension 114 as a single unitary component. The driver 116 includes a driving member 174, which in the illustrated embodiment is a ¼ inch twelve point double hexagonal socket aperture configured to receive a nut, a bolt head, or the like. In other embodiments, the driving member 174 can have outer suitable sizes and the driving member can be other suitable types of driving members.

Referring to FIG. 10, the extension 114 includes a central aperture 185 that extends through the first end portion 180 and the second end portion 182 of the extension 114. The central aperture 185 has a minimum width 146 (i.e., minimum diameter in the illustrated embodiment). The aperture 185 is in open fluid communication with the driving member 174 and the width 146 is sized such that a bolt, threaded rod, or the like can extend into the aperture 185 all the way to the drive 112 when the fastener drive and extension 110 is being used to rotate a nut, a bolt or the like. The aperture 185 has a length 186 defined as the distance from the driver 116 to the aperture 184 along the longitudinal axis of the aperture 185 as illustrated in FIG. 8.

In operation, referring to FIG. 10, the user inserts the shank 128 of the drive 112 into the chuck of a rotary power tool, such as a drill. The user inserts the square drive 130 into the square aperture 184 of the extension 114. Then, the user places a fastener, such as a nut, into the driving member 174 and rotates the nut using the rotary power tool 110 to advance or position the nut along a threaded rod or bolt. In one application, the nut is driven a relatively large distance along the bolt or threaded rod. The length 186 and the width 146 of the aperture 185 allows the threaded rod or bolt to travel into the aperture 185 in the direction of arrow 188 until the rod or bolt reaches the drive 112 (i.e., the nut can be driven about the distance 186 along the threaded rod or bolt). Accordingly, the fastener can be advanced a relatively large distance along the threaded rod or bolt.

In one embodiment, the extension 114 can be supplied as part of a kit including multiple extensions having different aperture lengths 186 (e.g., 12 inches, 24 inches, etc.). In other embodiments, the extension 114 can be telescoping such that the user can adjust the length of the extension 114 or the length 186 of the aperture 185. In yet other embodiments, the use can adjust the length using other devices. For example, in once such embodiment, the extension 114 may include additional extension pieces that can be placed between the first end portion 180 and the second end portion 182 of the extension 114 to increase the length 186 of the aperture 185.

Figure 11:
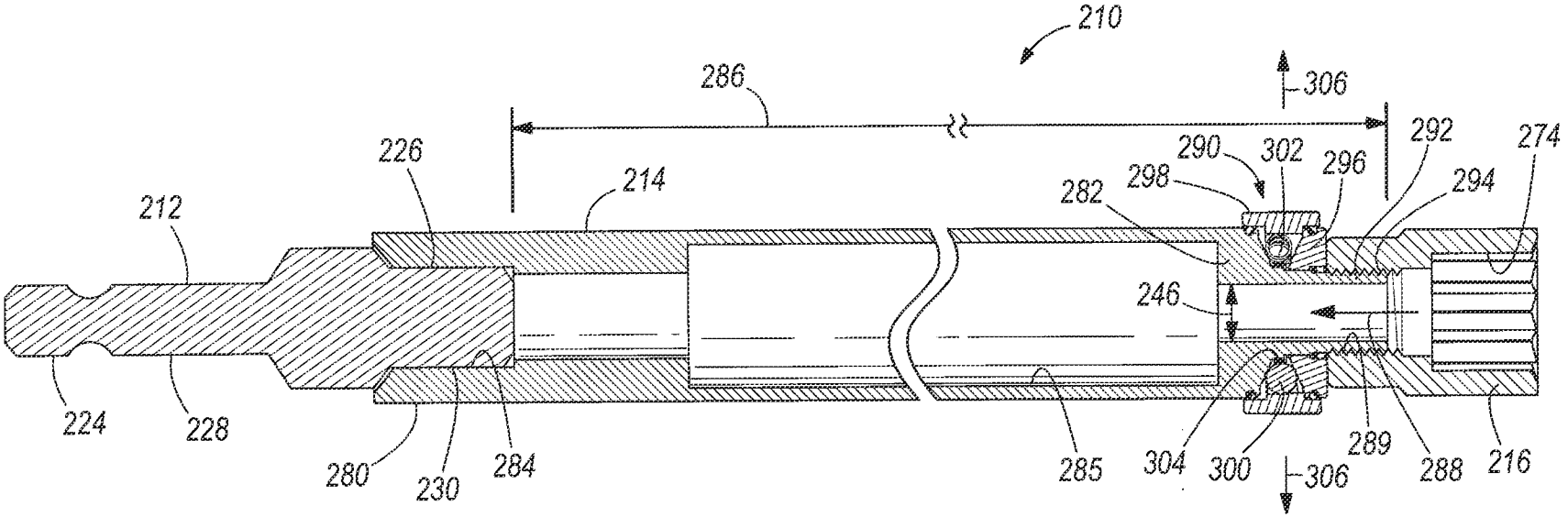
FIG. 11 is a cross-sectional view of a fastener driver and extension according to another embodiment of the invention.

FIG. 11 illustrates a fastener driver and extension 210 according to another embodiment. The fastener driver and extension 210 includes features similar to the fastener driver and extensions 10 and 110 of FIGS. 1-10 and like components have been give like reference numbers in the 200 series and only differences between the fastener driver and extensions 10, 110, 210 will be discussed in detail below.

The fastener driver and extension 210 includes an extension 214 and a driver 216 that is removably coupled to the extension 214 to allow the user to replace the driver 216 with a different sized driver that can rotate a different sized fastener.

The driver 216 includes a threaded aperture 289. The extension 214 includes a release mechanism 290 and a connector 292. In the illustrated embodiment, the connector 292 includes a threaded portion 294 at a second end portion 282 of the extension 214 that is received in the threaded aperture 289 of the driver 216. The release mechanism 290 includes a friction member 296, an actuating member or collar 298, roller elements 300, spring elements 302, and radially acting springs 304. Embodiments of the release mechanism 290 are illustrated and described in U.S. Patent Application Publication No. 2011/0097169, the entire contents of which are hereby incorporated by reference herein.

In operation, the user attaches the driver 216 to the extension 214 by inserting the threaded portion 294 into the threaded aperture 289 of the driver 216. The user rotates the driver 216 until the driver 216 firmly presses against the friction member 296 and the driver 216 is securely coupled to the extension 214. Then, the user can use the fastener driver and extension 210 to rotate a fastener as described above with regard to the fastener driver and extension 110. In one embodiment, the fastener driver and extension 210 includes multiple drivers 216 having different sized or different types of driving members 274. In such an embodiment, the user can remove the illustrated driver 216 and replace the driver 216 with a similar, but different size or type of driver. To remove the driver 216, the user rotates the collar 298 about the aperture 185. Rotation of the collar 298 allows the springs 304 to radially expand the roller elements 300 relative to each other in the direction of arrows 306 (FIG. 11). This movement of the roller elements 300 allows the friction member 296 to move slightly in the direction of arrow 288, which reduces the compressive force on the friction member 296 from the driver 216. Then, the user can relatively easily remove the driver 216 by rotating the driver 216 on the threaded portion 294.

Although the invention has been described in detail with reference to certain preferred embodiments, variations and modifications exist with the scope and spirit of one or more independent aspects of the invention as described.

Various features and advantages of the invention are set forth in the following claims.

What is claimed is:

1. A fastener driver configured for use with a rotary power tool having a chuck, the fastener driver including:

a drive including a first end portion having a shank configured to be received in the chuck of the rotary power tool to couple the fastener driver to the rotary power tool for rotation with the chuck, and a second end portion opposite the first end portion;

an elongated extension including a first end, a second end, an aperture that extends through the first end and the second end, and the drive removably coupled to the elongated extension adjacent the first end of the extension;

a driver including a first end, a second end, an aperture that extends through the first end and the second end, a drive member adjacent the first end of the driver configured to engage a fastener to rotate the fastener, and the driver removably coupled to the elongated extension adjacent the second end of the elongated extension to allow the fastener to pass through the aperture of the driver and into the aperture of the elongated extension; and a connector that couples the driver to the drive for co-rotation without the elongated extension when the elongated extension is not utilized and the connector couples the driver, the elongated extension, and the drive for co-rotation when the elongated extension is utilized, wherein the drive includes a second aperture proximate the second end portion, and wherein the elongated extension is received in the second aperture of the drive when the elongated extension is coupled to the drive, wherein the drive includes a first aperture different from the second aperture proximate the second end portion, and wherein the driver is received in the first aperture of the drive when the driver is coupled to the drive without the elongated extension.

2. The fastener driver of claim 1, wherein the elongated extension is cylindrical.

3. The fastener driver of claim 2, wherein the elongated extension includes a cylindrical outer surface that extends from the first end to the second end.

4. The fastener driver of claim 1, wherein the drive member includes a hex-shaped recess.

5. The fastener driver of claim 1, wherein the first aperture of the drive and the second aperture of the drive are generally cylindrical.

6. The fastener driver of claim 5, wherein the first aperture of the drive and the second aperture of the drive are concentric.

7. The fastener driver of claim 1, wherein the connector includes a sleeve, a first fastener, and a second fastener, and wherein the first fastener couples the sleeve to the drive.

8. The fastener driver of claim 7, wherein the second fastener couples the driver to the sleeve to couple the drive and the driver for co-rotation when the extension is not utilized, and wherein the second fastener couples the elongated extension and the driver for co-rotation when the elongated extension is utilized and the first fastener couples the elongated extension to the drive for co-rotation when the elongated extension is utilized.

9. A fastener driver configured for use with a rotary power tool having a chuck, the fastener driver including:

a drive including a first end portion having a shank configured to be received in the chuck of the rotary power tool to couple the fastener driver to the rotary power tool for rotation with the chuck, and a second end portion opposite the first end portion;

an elongated extension including a first end, a second end, a cylindrical outer surface that extends from the first end to the second end, an aperture that extends through the first end and the second end, and the drive removably coupled to the elongated extension adjacent the first end of the extension;

a driver including a first end, a second end, an aperture that extends through the first end and the second end, a drive member adjacent the first end of the driver configured to engage a fastener to rotate the fastener, and the driver removable coupled to elongated extension adjacent the second end of the elongated extension to allow the fastener to pass through the aperture of the driver and into the aperture of the elongated extension, wherein the drive includes a second aperture proximate the second end portion, and wherein the elongated extension is received in the second aperture of the drive when the elongated extension is coupled to the drive, wherein the drive includes a first aperture different from the second aperture proximate the second end portion, and wherein the driver can be received in the first aperture of the drive when the driver is coupled to the drive without the elongated extension.

10. The fastener driver of claim 9, wherein the drive member includes a hex-shaped recess.

11. The fastener driver of claim 9, wherein the driver can be removable coupled to the drive without the elongated extension.

12. The fastener driver of claim 9, wherein the first aperture of the drive and the second aperture of the drive are generally cylindrical.

13. The fastener driver of claim 12, wherein the first aperture of the drive and the second aperture of the drive are concentric.

14. The fastener driver of claim 9, further comprising a connector that couples the driver to the drive for co-rotation without the elongated extension when the elongated extension is not utilized and the connector couples the driver, the elongated extension, and the drive for co-rotation when the elongated extension is utilized.

15. The fastener driver of claim 14, wherein the connector includes a sleeve, a first fastener, and a second fastener, and wherein the first fastener couples the sleeve to the drive.

16. The fastener driver of claim 15, wherein the second fastener couples the driver to the sleeve to couple the drive and the driver for co-rotation when the extension is not utilized, and wherein the second fastener couples the elongated extension and the driver for co-rotation when the elongated extension is utilized and the first fastener couples the elongated extension to the drive for co-rotation when the elongated extension is utilized.

* * * * *